US011143189B2

(12) United States Patent
Ifrim et al.

(10) Patent No.: US 11,143,189 B2
(45) Date of Patent: Oct. 12, 2021

(54) INTEGRATED MODULAR, MULTI-STAGE MOTOR-PUMP/COMPRESSOR DEVICE

(71) Applicant: FMC Technologies, Inc., Houston, TX (US)

(72) Inventors: Costin Ifrim, Orange, CA (US); Bradley Dean Beitler, Houston, TX (US); Bryan Wang Lam, Redondo Beach, CA (US); Brian Scott Dejarnett, Irvine, CA (US)

(73) Assignee: FMC Technologies, Inc., Houston, TX (US)

( * ) Notice: Subject to any disclaimer, the term of this patent is extended or adjusted under 35 U.S.C. 154(b) by 420 days.

(21) Appl. No.: 16/071,638

(22) PCT Filed: Jan. 22, 2016

(86) PCT No.: PCT/US2016/014418
§ 371 (c)(1),
(2) Date: Jul. 20, 2018

(87) PCT Pub. No.: WO2017/127101
PCT Pub. Date: Jul. 27, 2017

(65) Prior Publication Data
US 2019/0032667 A1 Jan. 31, 2019

(51) Int. Cl.
*F04D 13/06* (2006.01)
*F04D 3/02* (2006.01)
(Continued)

(52) U.S. Cl.
CPC ..... *F04D 13/06* (2013.01); *F04D 3/02* (2013.01); *F04D 13/0646* (2013.01);
(Continued)

(58) Field of Classification Search
CPC ... F04D 3/00; F04D 3/02; F04D 13/06; F04D 13/0633; F04D 13/064; F04D 13/0646;
(Continued)

(56) References Cited

U.S. PATENT DOCUMENTS 2,319,730 A * 5/1943 Garraway ..... F04D 1/06 417/356
2,898,032 A 8/1959 Katzenberger
(Continued)

FOREIGN PATENT DOCUMENTS

EP 0462724 12/1991
EP 3332125 6/2018
(Continued)

OTHER PUBLICATIONS

U.S. Appl. No. 62/201,933, filed Aug. 2015, Brunvold; Anders.*
(Continued)

*Primary Examiner* — Dominick L Plakkoottam
*Assistant Examiner* — Charles W Nichols
(74) *Attorney, Agent, or Firm* — Fish & Richardson P.C.

(57) ABSTRACT

A novel integrated modular, multi-stage motor-pump/compressor device (10) is disclosed herein. In one example, the device (10) includes an outer housing (12) an electric motor stator (25) positioned within the outer housing (12) and a rotatable integrated motor/pump rotor (18) positioned within the electric motor stator (25). The rotatable integrated motor/pump rotor (18) comprises at least one electromagnet driver device (42, 33, 37) that is adapted to be electromagnetically coupled with the electric motor stator (25) and at least one impeller (28), where an inner surface (34A) of the rotatable integrated motor/pump rotor (18) and the impeller (28) define a primary process fluid flow path (36) within the rotatable integrated motor/pump rotor (18).

15 Claims, 13 Drawing Sheets

(51) Int. Cl.
*F04D 19/02* (2006.01)
*F04D 25/06* (2006.01)
*F04D 29/046* (2006.01)

(52) U.S. Cl.
CPC ..... *F04D 19/02* (2013.01); *F04D 25/0606* (2013.01); *F04D 29/046* (2013.01)

(58) Field of Classification Search
CPC ..... F04D 13/0653; F04D 13/08; F04D 19/02; F04D 19/022; F04D 19/024; F04D 25/0606; F04D 25/062; F04D 25/064; F04D 25/0646; F04D 25/066; F04D 29/046; F04D 29/0465
See application file for complete search history.

(56) References Cited

U.S. PATENT DOCUMENTS

| | | | | |
|---|---|---|---|---|
| 3,143,972 | A | 8/1964 | Smith et al. | |
| 5,289,068 | A | 2/1994 | Veronesi et al. | |
| 7,150,600 | B1 * | 12/2006 | Vennat | E21B 43/128 415/199.2 |
| 9,217,435 | B2 * | 12/2015 | Moore | F04D 3/00 |
| 2015/0285251 | A1 * | 10/2015 | Welschinger | F04D 29/086 415/83 |
| 2017/0159665 | A1 * | 6/2017 | Bergamini | F04D 19/024 |

FOREIGN PATENT DOCUMENTS

| | | |
|---|---|---|
| WO | WO15114136 | 8/2015 |
| WO | 2017021553 | 2/2017 |

OTHER PUBLICATIONS

International Search Report/Written Opinion dated Sep. 30, 2016, issued by European Patent Office, 101 pgs.
European Communication Pursuant to Article 94(3) issued in European Application No. 16702653.3-1007 dated Oct. 21, 2019, 9 pages.
European Communication Pursuant to Article 94(3) issued in European Application No. 16702653.3 dated Apr. 6, 2020, 7 pages.

* cited by examiner

INTEGRATED MODULAR, MULTI-STAGE MOTOR-PUMP/COMPRESSOR DEVICE

This application is a National Stage Application under 35 U.S.C. § 371 and claims the benefit of International Application No. PCT/US2016/014418, filed Jan. 22, 2016. The disclosure of the foregoing application is hereby incorporated by reference in its entirety.

FIELD OF INVENTION

The present invention generally relates to motors, compressors and pumps that may be used in, for example, the oil and gas industry and, more particularly, to a unique to an integrated modular, multi-stage motor-pump/compressor device.

BACKGROUND OF THE INVENTION

Electrically driven pumps/compressors have been in common use for many years. Such electrically driven pumps/compressors are commonly employed within various industries including the oil and gas industry. The pump/compressor may be positioned on land or in a subsea location. Pumps have been used to pump multiphase fluids, typically including any pump-able combination of oil, gas, water and/or solids, as well as single-phase fluids, e.g. water and/or oil. Compressors have been used in applications where the process fluid is primarily a compressible gas. In many applications, a separate electric induction motor is used to drive a separate pump/compressor device. The electric motor is typically coupled to the pump/compressor device using a flexible coupling. The motor may come in a. variety of forms, e.g., a permanent magnet motor, a squirrel cage motor, etc., and it may be driven using either an alternating current power supply or a direct current power supply. The pump/compressor may comprise many stages and they may be designed to operate in a. vertical or horizontal position. Depending upon the pressure of the process fluid, the housings of both the pump/compressor and the motor are separately sized as pressure vessels. Accordingly, the pump/compressor - motor assemblies could end up being very large and heavy assemblies.

Typically, a prior art pump/compressor comprised one or more impellers that are coupled to a rotating shaft. As the shaft rotates, the impellers impart the desired energy to the process fluid flowing though the pump/compressor. Due to the rotation of the impellers, the process fluid is forced radially outward and gap was provided between the outer surface of the impeller and a non-rotating housing in which the rotating impellers were positioned. Such an arrangement led to some operating inefficiencies as a not-insignificant amount of the process fluid could effectively bypass the impellers.

The present application is directed to an integrated modular, multi-stage motor-pump/compressor device that may eliminate or at least minimize some of the problems noted above.

BRIEF DESCRIPTION OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

The present application is generally directed to an integrated modular, multi-stage motor-pump/compressor device. In one illustrative embodiment, the device includes an outer housing, an electric motor stator positioned within the outer housing and a rotatable integrated motor/pump rotor positioned within the electric motor stator. In one example, the rotatable integrated motor/pump rotor comprises at least one electromagnet driver device that is adapted to be electromagnetically coupled with the electric motor stator and at least one impeller, where an inner surface of the rotatable integrated motor/pump rotor and the impeller define a primary process fluid flow path within the rotatable integrated motor/pump rotor.

In other embodiments, the device comprises a non-rotating shaft that is fixed within the outer housing of the device, wherein the rotatable integrated motor/pump rotor is positioned around the non-rotating shaft and the rotatable integrated motor/pump rotor is adapted to rotate around the non-rotating shaft during operation. In some embodiments, a diffuser that is positioned axially downstream of the impeller is rotationally fixed to the non-rotating shaft. The diffuser is adapted to accept process fluid that flows through the impeller. In other embodiments, the device may include a conical member that is fixed to the non-rotating shaft and positioned between the impeller and the shaft. In yet other embodiments, the device may include segmented rotatable journal bearing positioned between the impeller and the non-rotating shaft, wherein the segmented rotatable journal bearing is coupled to the impeller and rotates around the non-rotating shaft with the impeller.

In other examples of the device disclosed herein, the rotatable integrated motor/pump rotor is rotationally supported by an plurality of external journal bearings and a plurality of inner journal bearings. The external journal bearings are positioned between a portion of the outer housing and around an outer surface of the rotatable integrated motor/pump rotor. The inner journal bearings are positioned between an inner surface of the rotatable integrated motor/pump rotor and an outer surface of the non-rotating shaft, wherein the inner journal bearings are fixedly attached to the inner surface of the rotatable integrated motor/pump rotor. In more detailed embodiments, the inner journal bearings and the outer journal bearings may be positioned such that the axial length of the inner journal bearings overlaps at least partially with the axial length of the outer journal bearings along the axial length of the rotatable integrated motor/pump rotor.

In yet another example of the device disclosed herein, the electromagnet driver device has a first axial length along the rotatable integrated motor/pump rotor and the plurality of the impellers positioned along the rotatable integrated motor/pump rotor have a second axial length that is greater than the first axial length.

As yet another example of the device disclosed herein, the structural shell of the rotatable integrated motor/pump rotor is mechanically designed based upon a differential pressure between a first pressure of a process fluid flowing through the rotatable integrated motor/pump rotor and a second pressure of a fluid positioned within the outer housing of the device and external to the structural shell the rotatable integrated motor/pump rotor, wherein the second pressure is adjusted to be greater than the first pressure.

BRIEF DESCRIPTION OF THE DRAWINGS

The present invention will be described with the accompanying drawings, which represent a schematic but not limiting its scope.

Figure 1A:
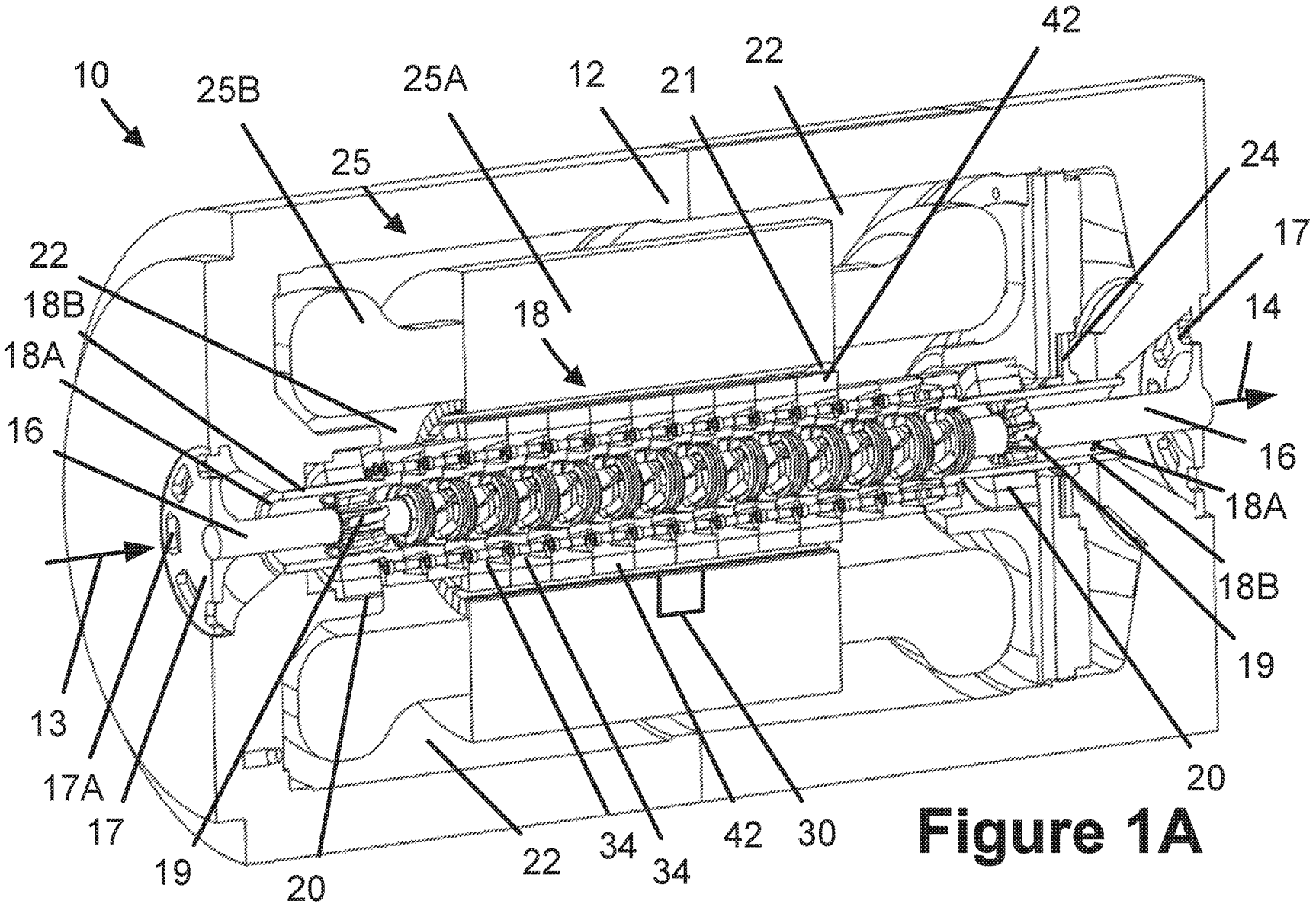
FIGS. 1A-1B are, respectively, a perspective, cross-sectional view and a cross-sectional side view of one illustrative embodiment of an integrated modular, multi-stage motor pump/compressor device disclosed herein.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Various illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 1B:
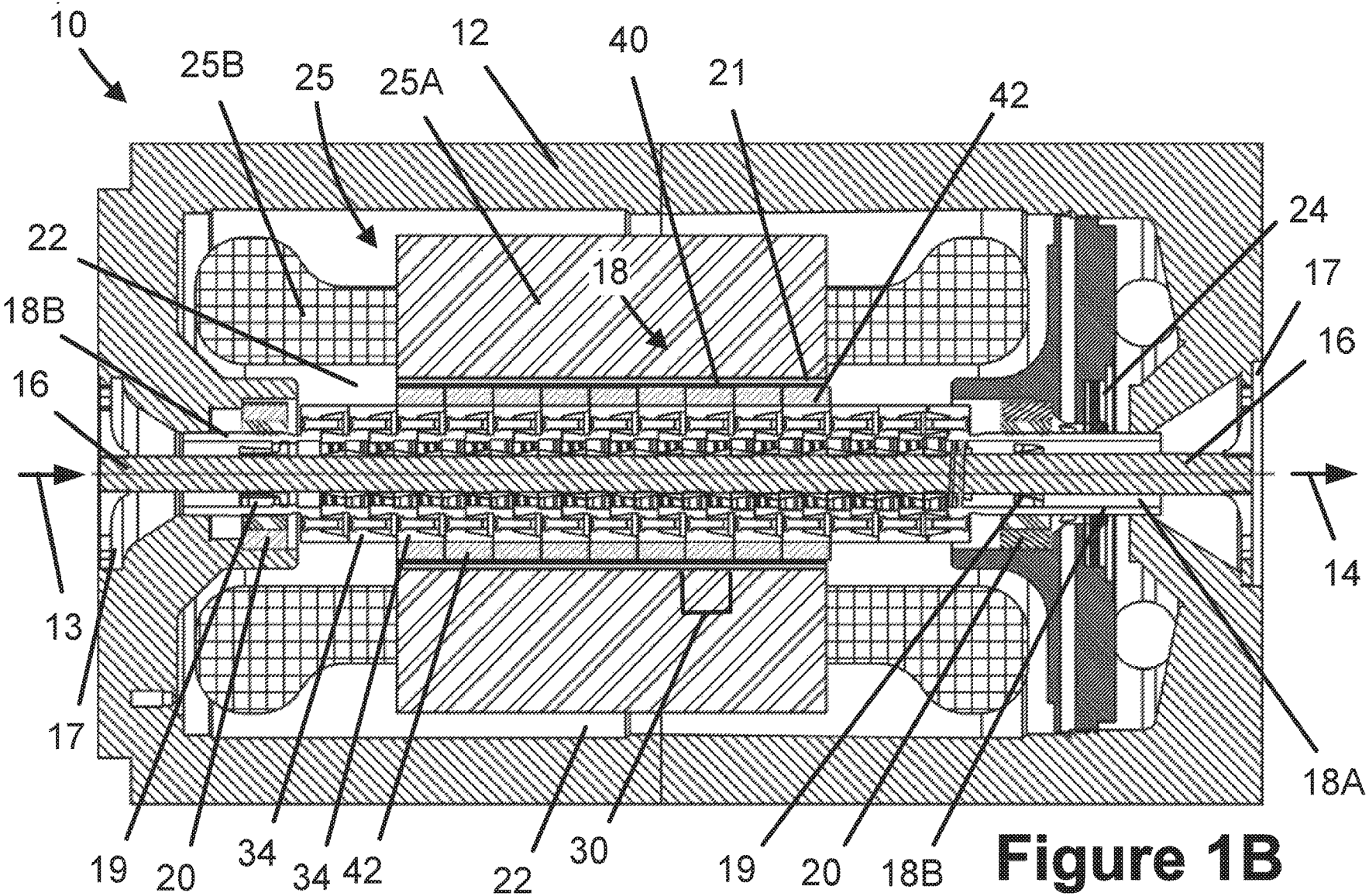

The basic structure of various embodiments of a novel integrated modular, multi-stage motor pump/compressor device 10 disclosed herein will be described with reference to the attached figures. In general, the device 10 disclosed herein may he used as a pump (when the process fluid is comprised primarily of an incompressible liquid or in some multi-phase flow applications) or as a compressor (when the process fluid is comprised primarily of a gas). FIGS. 1A-1B are, respectively, a perspective, cross-sectional view and a cross-sectional side view of one illustrative embodiment of an integrated motor—pump/compressor device 10 disclosed herein. With reference to FIGS. 1A-1B, the device 10 generally comprises an outer housing 12, a process fluid inlet 13, a process fluid outlet 14, a non-rotating shaft 16, a rotating integrated motor/pump rotor 18 and a motor stator assembly 25 that is mechanically fixed to the outer housing 12. In general, the rotating integrated motor/pump rotor 18 has an overall tubular like configuration. The motor stator assembly 25 is comprised of an illustrative electromagnetic stator core 25A and illustrative winding end turns 25B. The motor stator assembly 25 is separated from the integrated motor/pump rotor 18 by a magnetic gap 21. In some applications, a cooling fluid (not shown) may be positioned in the spaces 22 between the housing 12 and the other components of the device 10. For example, such a cooling fluid may be positioned in all open spaces 22, inside the slots and windings of the motor stator assembly 25, around the outside surfaces of the integrated motor/pump rotor 18 and in the magnetic gap 21.

During operation, the integrated motor/pump rotor 18 rotates about the fixed shaft 16 and within an opening in the fixed motor stator assembly 25. The non-rotating shaft 16 is fixedly coupled to the housing 12 via flanged connections 17 that include hydraulic openings 17A for facilitating the flow of process fluid into (13) and out of (14) the device 10. Separation of the process fluid that flows through the integrated motor/pump rotor 18 and the cooling fluid in the spaces 22 within the housing 12 may be accomplished using a variety of sealing mechanisms. In one illustrative embodiment, such separation may be obtained by use of a set of hydraulic seals located between the ends of the rotating integrated motor/pump rotor 18 and the end-bells (of the housing 12) and the flanges 17 that are coupled to the end-bells. For example, the sealing between the end-bells and the flanges 17 may be established by metal-to-metal contact between portions of the end bells' housing and the tubular rotatable extensions 18B of the housing members 34. In other applications, the end bells' housing and the tubular rotatable extensions 18B of the housing members 34 may be operatively sealed to one another by positioning gaskets (not shown) or the like between the end bells' housing and the tubular rotatable extension of the housing members 34.

The rotational movement of the integrated motor/pump rotor 18 within the motor stator assembly 25 is supported by illustrative outer journal bearings 20 and illustrative internal journal bearings 19. The outer journal bearings are positioned within the outer housing 12 and allow the integrated motor/pump rotor 18 to rotate relative to the motor stator assembly 25. The internal journal bearings 19 allow the integrated motor/pump rotor 18 to rotate relative to the non-rotating shaft 16. In the depicted example, the integrated motor/pump rotor 18 comprises extended length portions 18B that extend through openings in the outer journal bearings 20. The outer surfaces of the illustrative internal journal bearings 19 are fixed (e.g., welded, press fit, etc.) to the internal surface 18A of the extended length portions 18B of the integrated motor/pump rotor 18 such that, in operation, the internal journal bearings 19 rotate with the integrated motor/pump rotor 18. A thrust bearing 24 is provided to resist biased axial loads created during operation, such as when the integrated motor/pump assembly 10 is operated in a vertical position. In the depicted example, the integrated motor/pump rotor 18 comprises a plurality of segmented housing members 34 that are secured to one another in a back-to-back fashion. The plurality of segmented housing members 34, in combination with the extended length portions 18B, defines the overall axial length of the integrated motor/pump rotor 18.

The integrated motor pump/compressor device 10 also comprises multiple motor-pump/compressor stages 30 that extend back-to-back along the axial length of the integrated motor/pump rotor 18. In some embodiments, each of the stages 30 comprises at least one diffuser 26 that is fixed to the non-rotating shaft 16 and one or more impellers 28 that are operatively coupled to the integrated motor/pump rotor 18 such that, during operation, when the integrated motor/pump rotor 18 is electromagnetically energized from the stator assembly 25 through the magnetic gap 21, the impellers 28 rotate (along with the integrated motor/pump rotor 18) relative to the non-rotating shaft 16 to impart the desired energy to the process fluid flowing through the device 10.

Figure 1C:
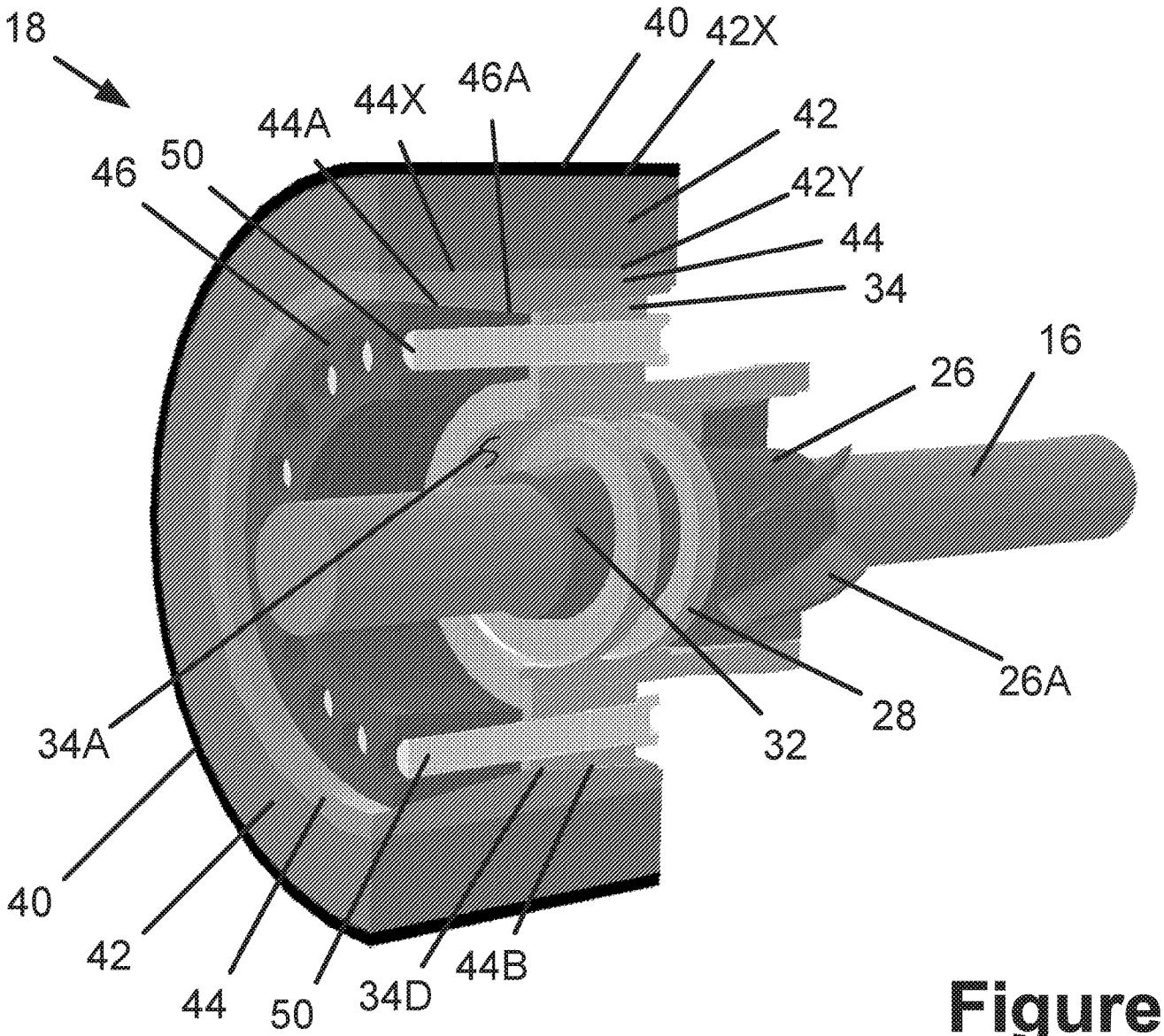
FIG. 1C is a perspective, cross-sectional view of a portion of illustrative embodiments of an integrated modular, multi-stage motor—pump/compressor device disclosed herein.
Figure 2A:
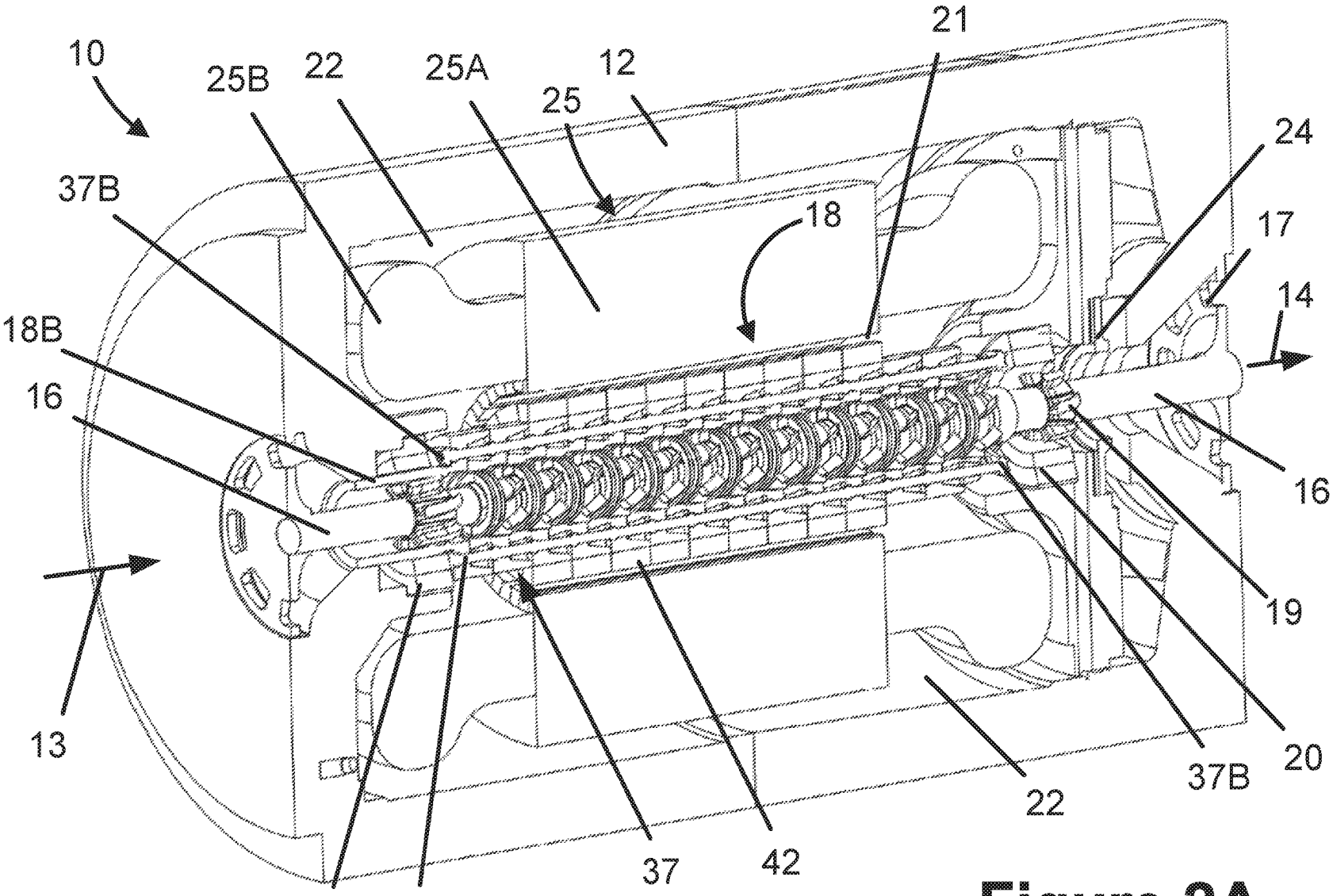
FIGS. 2A-2B are, respectively, a perspective, cross-sectional views of other illustrative embodiments of an integrated modular, multi-stage motor—pump/compressor device disclosed herein
Figure 2B:
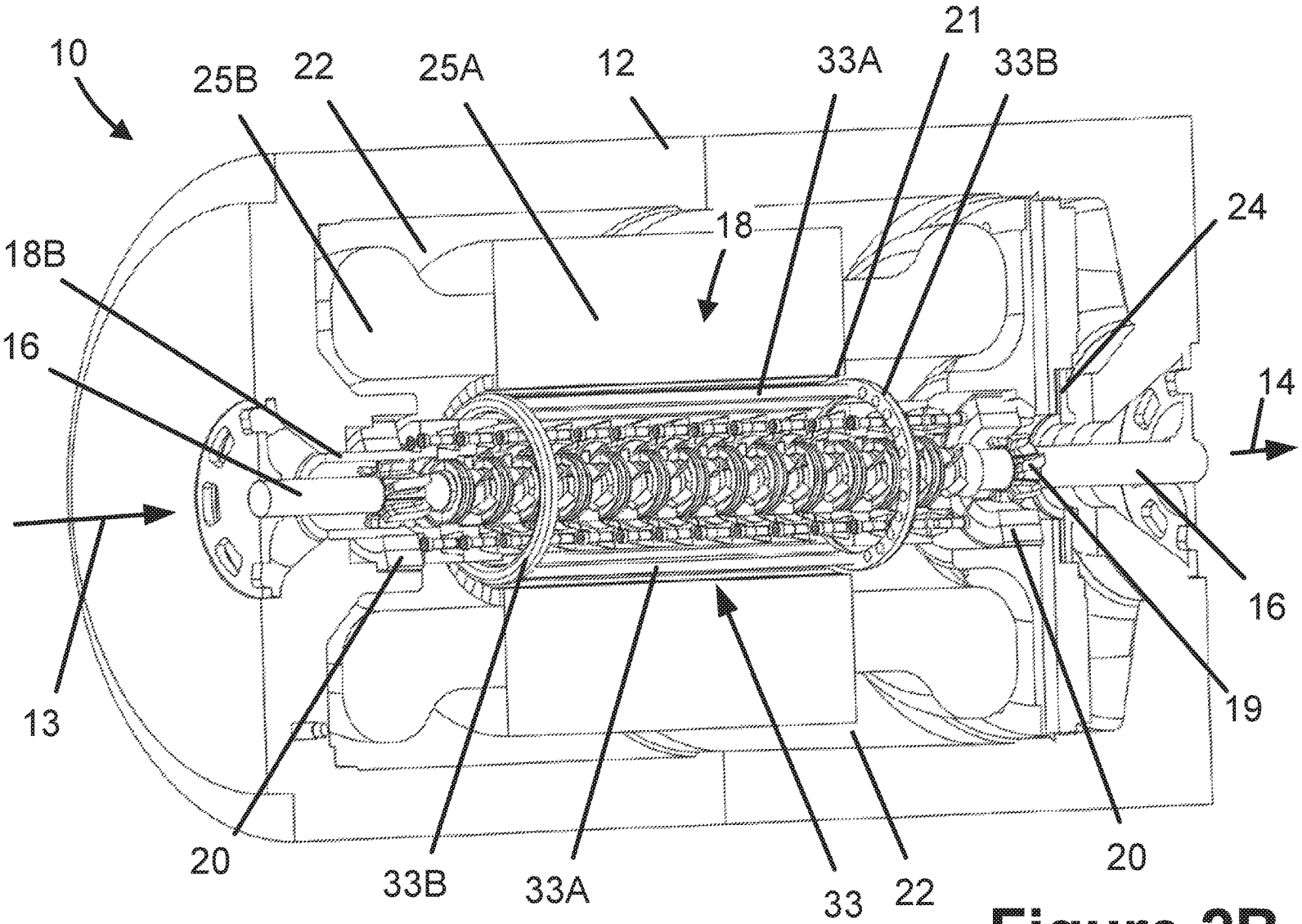

The integrated motor/pump rotor 18 disclosed herein may take a variety of forms and it may comprises a variety of different components. In the example depicted in FIGS. 1A-1C, the modular motor portion of the integrated motor/pump rotor 18 comprises an outer shell 40 (see FIGS. 1B and 1C), a permanent magnet assembly 42 that is comprised of a plurality of permanent magnets, and a shaped inner core 44 (as shown in FIG. 1C). As depicted, the permanent magnet assembly 42 is positioned radially inward of the outer shell 40, and, as depicted in the example shown in FIG. 1C, the shaped inner core 44 is positioned radially inward of the permanent magnet assembly 42. Various tapered surfaces (discussed more fully below) are formed on the components of the integrated motor/pump rotor 18 to facilitate assembly of the device 10. In one embodiment, where the device includes the shaped inner core 44 as a separate component (e.g., see FIG. 1C), some of the tapered surfaces may be formed on the inner surface of the shaped inner core 44. However, in other applications, the device 10 may not include a separate shaped inner core 44 or the structure of the shaped inner core 44 may be effectively embedded or include as part of the segmented housing members 34. See, e.g., FIGS. 1A-1B, 4 and 5A-5B. In such cases, the various tapered surfaces may be formed only on the outer surface of the segmented housing members 34 which are, in turn, directly attached to the inner surface of the permanent magnet assembly 42. In cases where the device 10 does not include a permanent magnet assembly 42, the assembly 42 is essentially replaced with a set of laminations, as shown in FIG. 2B, which depicts an induction motor embodiment of the integrated motor/pump rotor assembly 18.

Of course, after a complete reading of the present application, those skilled in the art will appreciate that the integrated motor/pump rotor 18 component of the novel integrated motor pump/compressor device 10 disclosed herein may comprise a plurality of magnetic poles in either a permanent magnet or other types of electromagnetic driver devices. For example, FIG. 2A depicts another illustrative embodiment of the device 10 wherein the integrated motor/pump rotor 18 comprises a permanent magnet assembly 42 and an induction squirrel cage assembly 37 (the outer shell 40 and the shaped inner core 44 are omitted from this drawing). The induction squirrel cage assembly 37 is comprised of a plurality of bus bars 37A and the squirrel cage rings 37B that are concentrically aligned with the permanent magnet assembly 42 section of the integrated motor/pump rotor 18 which, in some instances, can be used for starting up the integrated motor/pump device 10 across the electrical grid lines or to mitigate operational torque transient effects. As another example, FIG. 2B depicts another embodiment of the device 10 wherein the integrated motor/pump rotor 18 comprises an induction motor segment 33 that is comprised of schematically depicted windings' bus bars 33A and squirrel cage end rings 33B. That is, in embodiment shown in FIG. 2B, the integrated motor/pump rotor 18 does not comprise a permanent magnet assembly 42.

As will be appreciated by those skilled in the art after a complete reading of the present application, the permanent magnet assembly 42 (FIG. 1A), the a combination of a plurality of permanent magnets and an induction rotor squirrel cage segment 37 (FIG. 2A) and the induction motor segment 33 (FIG. 2B) are mere examples of electromagnetic driver devices that are components of the rotating integrated motor/pump rotor 18. Such illustrative electromagnetic driver devices 42, 33, 37 are adapted to be electromagnetically coupled with the electric motor stator 25 when the device is operational so as to thereby provide the means to rotate the rotatable integrated motor/pump rotor 18. Thus, the inventions disclosed herein should not be considered to be limited to any particular form of electromagnetic driver device that is operatively coupled to the rotating integrated motor/pump rotor 18.

For ease of reference, more details of the presently disclosed inventions will be discussed in the context wherein the integrated motor/pump rotor 18 comprises the permanent magnet assembly 42 (with the plurality of permanent magnets) as depicted in FIGS. 1A-1C and FIG. 2A. However, the presently disclosed inventions should not be considered to be limited to the illustrative example disclosed herein where the integrated motor/pump rotor 18 is depicted as being comprised of an illustrative permanent magnet assembly 42.

Figure 3:
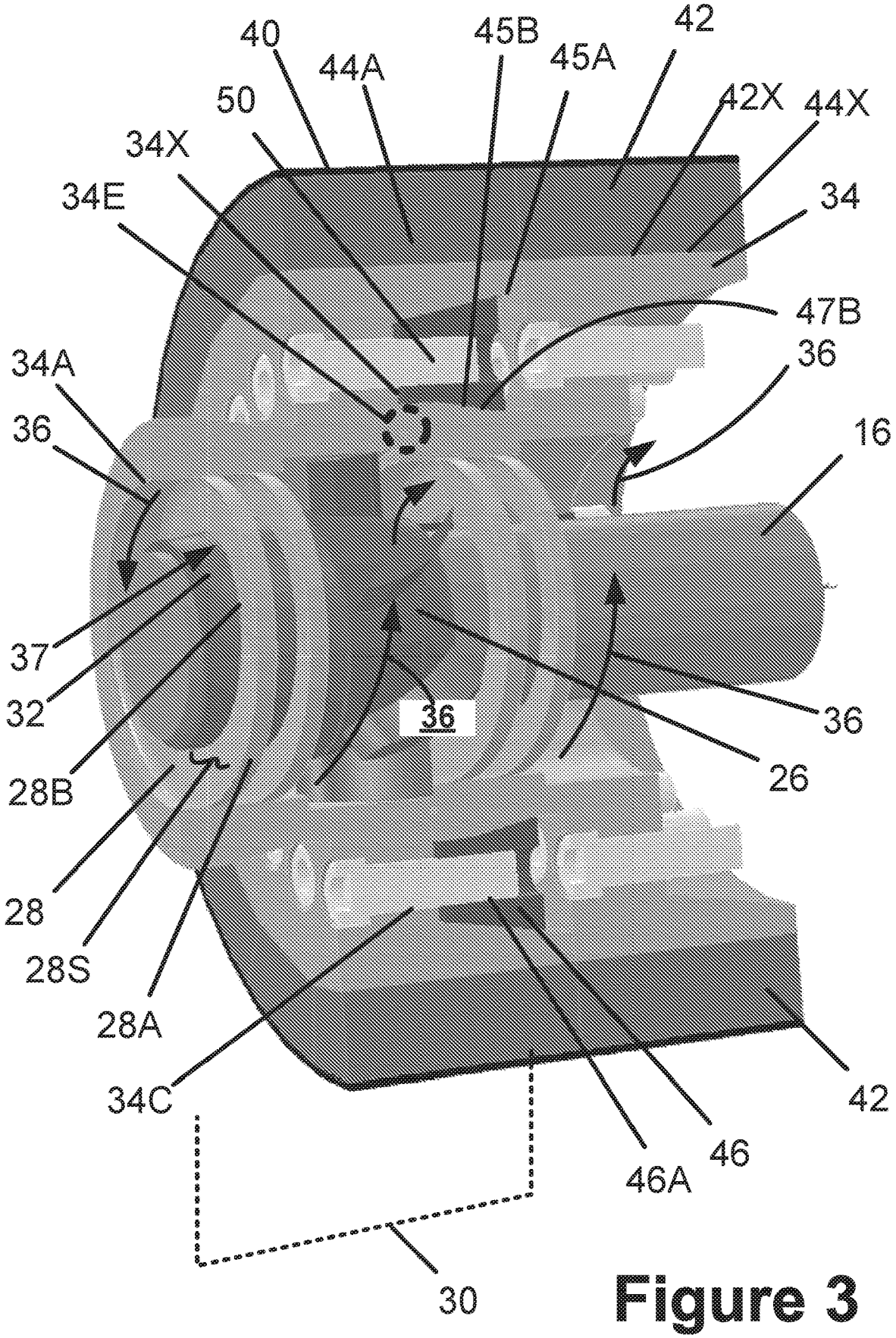
FIGS. 3 and 4 are perspective, cross-sectional views of portions of illustrative embodiments of an integrated modular, multi-stage motor—pump/compressor device disclosed herein.
Figure 4:
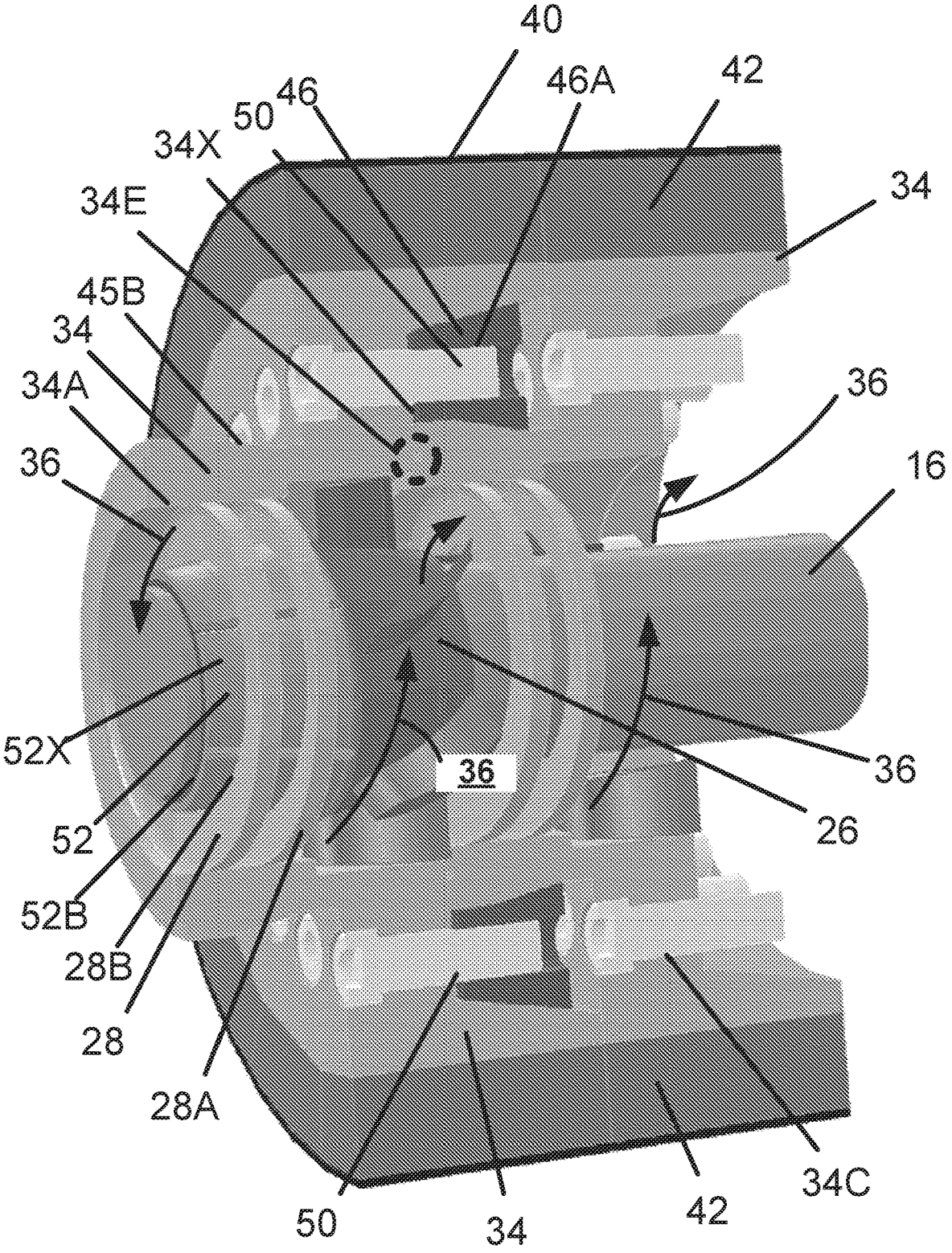
Figure 5A:
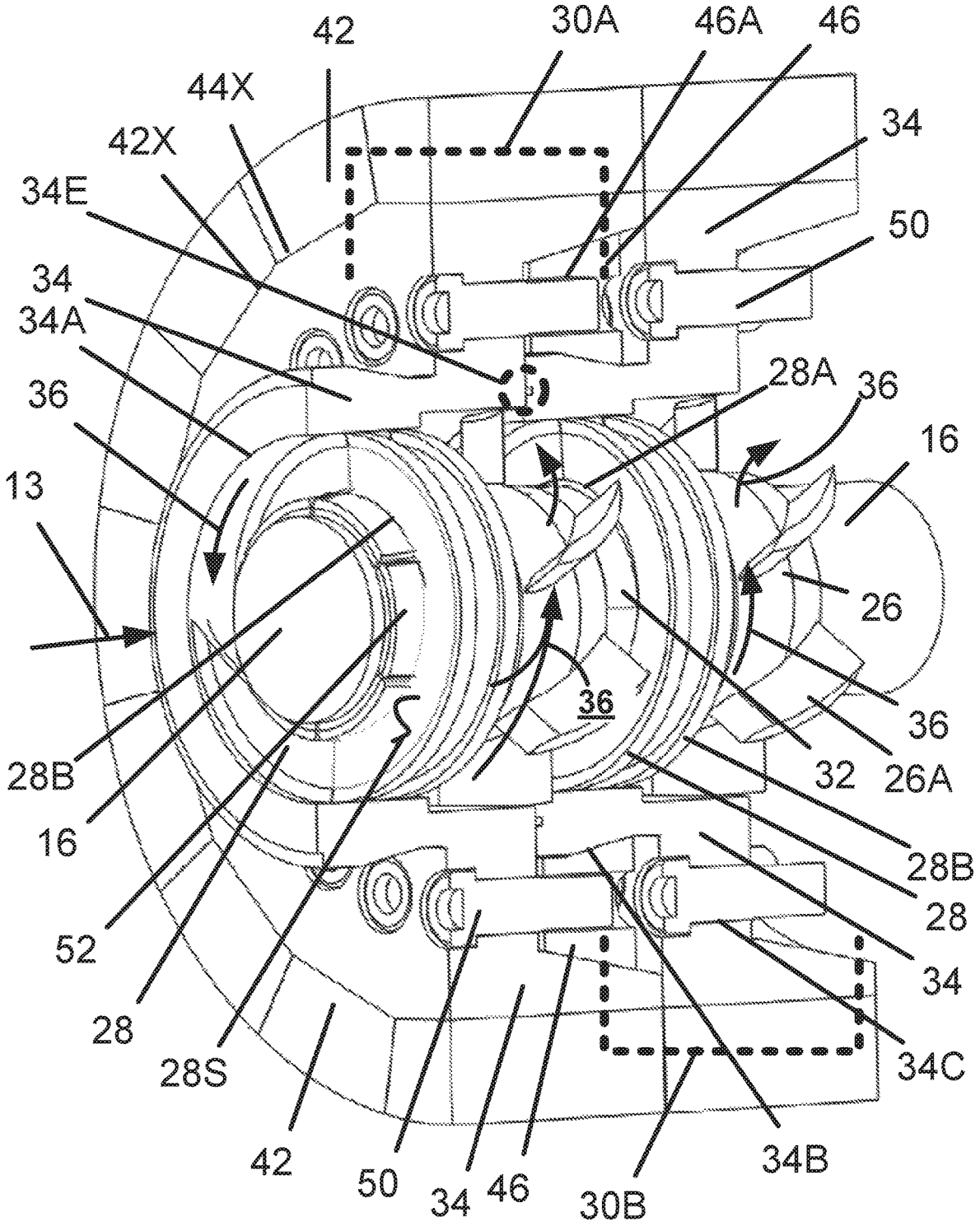
FIGS. 5A-5B are, respectively, a perspective, cross-sectional view and a cross-sectional side view of a portion of another illustrative embodiment of an integrated modular, multi-stage motor—pump/compressor device disclosed herein.
Figure 5B:
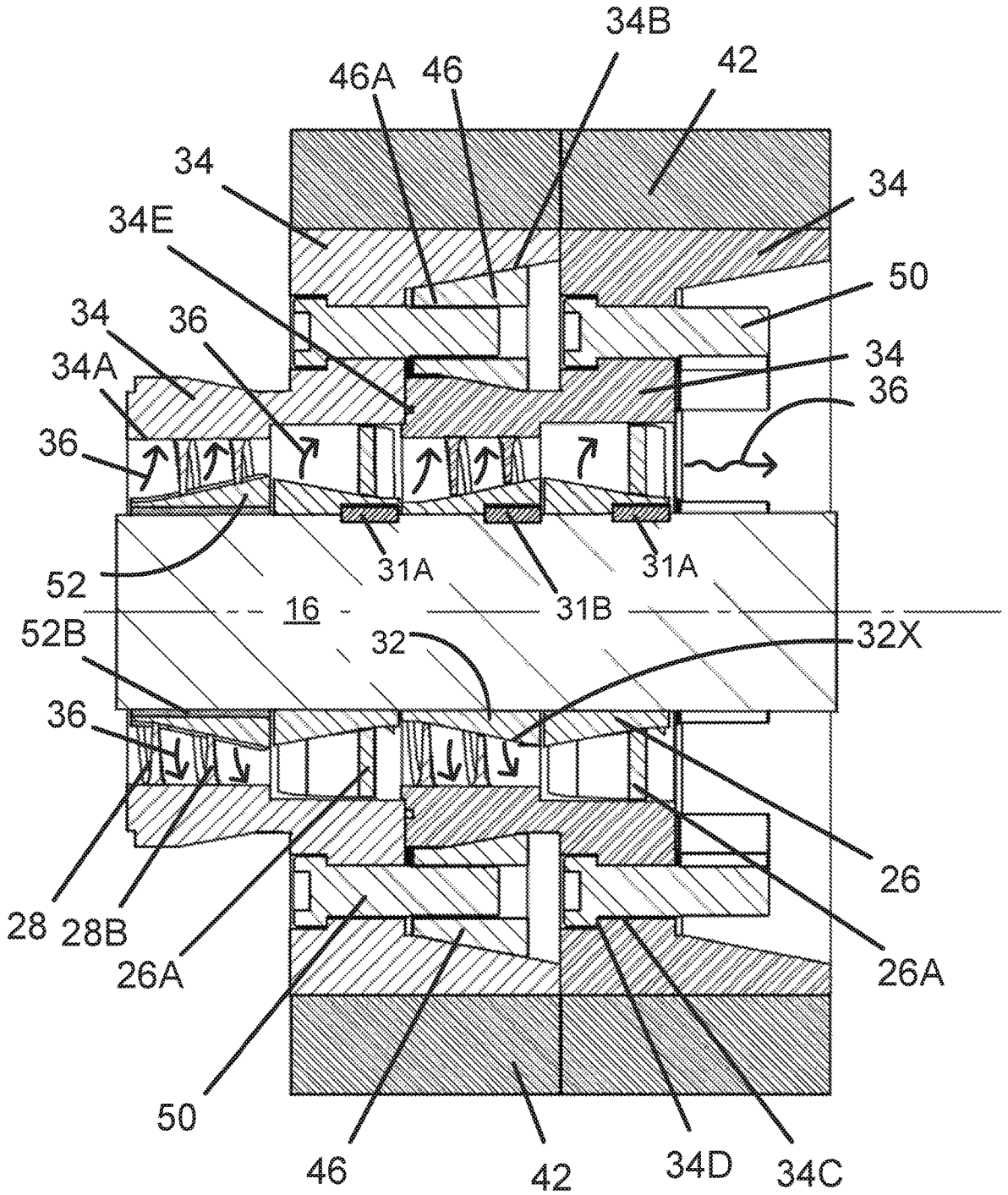

The next discussion will focus on the examples depicted in FIGS. 3, 4 and 5A-5B (the outer shell 40 is not shown in FIGS. 5A-5B). FIG. 3 is a perspective, cross-sectional view of one illustrative embodiment of the device 10 disclosed herein. In general, each of the motor-pump/compressor stages 30 in all of the devices disclosed herein comprises an impeller 28 and a diffuser 26 that are arranged axially within the integrated motor/pump rotor 18. The device 10 disclosed herein may include any number of such stages 30. The torque to energize the pump stages 30 is provided by the electromagnetic coupling between the stator 25 and the permanent magnet assembly 42. As depicted in FIG. 3, the diffuser 26 is positioned axially downstream of the impeller 28 so as to accept process fluid that flows through the impeller 28. The diffuser 26 is axially fixed in position along the non-rotating shaft 16 and fixed against rotation relative to the non-rotating shaft 16 by a keyed connection 31A (see FIG. 5B). The diffuser 26 may comprises any number of blades 26A. As described more fully below, the impellers 28 are coupled to and will rotate with the segmented housing members 34, as the housing members 34 are part of the integrated motor/pump rotor 18. In illustrative embodiment depicted in FIG. 3, a fixed conical member 32 is positioned between the impeller 28 and the non-rotating shaft 16. The conical member 32 is axially fixed in position along the non-rotating shaft 16 and fixed against rotation relative to the non-rotating shaft 16 by a keyed connection 31B (shown in FIG. 5B), Also note that, as shown in FIG. 5B, the axial position of the segmented rotatable journal bearing 52 along the non-rotating shaft 16 is secured by the immediately following downstream diffuser 26 which, in turn, is rotationally and axially fixed to the non-rotating shaft 16 by the locking key 31A. Additionally, the axial position of the impeller 28 along the non-rotating shaft 16 is secured via the attachment of the impeller 28 to the segmented rotatable journal bearing 52, whose axial position along the shaft 16 is secured as noted above. These keyed connections 31A, 31B also collectively act to distribute the force that acts on the thrust bearing 24.

FIG. 4 is a perspective, cross-sectional view of another illustrative embodiment of a portion of an integrated motor pump/compressor device 10 disclosed herein. Relative to the embodiment shown in FIG. 3, in this illustrative embodiment, the rotationally fixed conical member 32 has been replaced with a segmented rotatable journal bearing 52 that is fixed to the impeller 28. The segmented journal bearing 52 includes of a set of pads 52B that, during operation, are separated from the non-rotational shaft 16 by a process fluid film. As will be appreciated by those skilled in the art after a complete reading of the present application, any number of the segmented rotatable journal bearing 52 may be employed in the device 10 to assist with maintaining rotational stability of the integrated motor/pump rotor 18 during operations. As with the embodiment shown in FIG. 3, in the embodiment shown in FIG. 4, the impellers 28 are coupled to and will rotate with the segmented housing members 34, as the housing members 34 are pail of the integrated motor/pump rotor 18.

FIGS. 5A-5B are, respectively, a perspective, cross-sectional view and a cross-sectional side view of one illustrative embodiment of a device 10 comprising two integrated motor pump/compressor stages 30. In this example, the device 10 comprises an upstream stage 30A and a downstream stage 30B. The upstream stage 30A includes a segmented rotatable journal bearing 52 (like shown in FIG. 4) that is fixed to the impeller 28, while the downstream stage includes a conical member 32 (like shown in FIG. 3) that is fixed to the non-rotating shaft 16. In some applications, all of the stages 30 in the device 10 may comprise such segmented rotatable journal bearings 52, while in other applications all of the stages 30 of the device 30 may comprise fixed conical members 32. Any combination of segmented rotatable journal bearings 52 and/or fixed conical members 32 may be employed with the device 10 shown herein and there may or may not be equal spacing between the bearings 52 and the fixed conical members 32 when they are employed.

In all embodiments disclosed herein the impellers 28 are mechanically coupled to or formed integrally with the plurality of segmented housing members 34, which, in operation, rotate about the non-rotating shaft 16, That is, the impellers 28 are part of the integrated motor/pump rotor 18 which, in operation, rotates around the non-rotating shaft 16 within the non-rotating motor stator assembly 25. In one illustrative embodiment, the impellers 28 may be physically separate components that are mechanically coupled to the inside surface 34A of the housing member 34 by any known technique, e.g., welding or brazing, or as noted above, they may be formed integral with housing member 34 by performing a casting or machining operations, Irrespective of the manner in which the impellers 28 are operatively coupled to or formed as part of the housing member 34, there is little to no space between the inside surface 34A of the housing member 34 and what would be the outer surface 28A of the impellers 28 in the case where the impellers 28 are separate components that are attached to the housing member 34. That is, in the integrated motor pump/compressor device 10 disclosed herein, little to no process fluid can pass between the outer surface 28A of the impellers 28 and the inside surface 34A of the segmented housing members 34. As shown in FIGS. 3, 4 and 5A-5B, such an arrangement defines a helical-like or screw-like primary process fluid flow path 36 for the process fluid as it flows through the impeller 28 and around the outer surface of the fixed conical member 32 or a segmented rotatable journal bearing 52 as energy is added to the process fluid by the rotational action of the impellers 28. The process fluid flow path 36 is primarily defined by the sidewalls 28S of the impeller blade(s) and the inner surface 34A of the segmented housing members 34. This configuration of the process fluid flow path 36 forces the process fluid to be forced radially outward against the inner surface 34A of the segmented housing members 34 as it passes through the impeller 28 and the diffuser 26. This arrangement is advantageous for reasons that will he discussed more fully below.

With reference to FIG. 3, wherein the fixed conical member 32 is positioned between the non-rotating shaft 16 and the inner edge 28B of the impeller 28, the space between the inner edge 28B of the impeller 28 and the outer surface 32X of the conical member 32 defines a very small bypass fluid flow path 37 that is somewhat annular in configuration. The radial distance between the inner edge 28B of the impeller 28 and the outer surface 32X of the conical member 32 may be very small, e.g., or the order of about 0.3-0.5 mm. In general, given the nature of the operation of the device 10 disclosed herein, very little of the process fluid should flow through the bypass fluid flow path 37 shown in FIG. 3. thereby increasing the overall efficiency of the device 10 disclosed herein.

With reference to FIG. 4, wherein the journal bearing 52 is positioned between the impeller 28 and the non-rotating shaft 16, the outer surface 52X of the journal bearing 52 is coupled to substantially all of the inside surface 28B of the impeller 28 by, for example, welding, brazing or a dove-tail type assembly. Thus, in the embodiment shown in FIG. 4, there is essentially no flow path that corresponds to the bypass fluid flow path 37 described above with reference to FIG. 3. Very little process fluid will flow through the space between the pads 52B of the journal bearing 52 and the outer surface of the non-rotating shaft during operation. Accordingly, little to no process fluid can bypass the impellers 28 in the embodiment of the device 10 depicted in FIG. 4

With reference to FIGS. 3, 4 and 5A-5B, the integrated motor/pump rotor 18 comprises an outer shell 40 (not shown in FIGS. 5A-5B), an electromagnet assembly 42 (comprised of several individual permanent magnets) and a plurality of the segmented housing members 34 that includes the impellers 28. The segmented housing members 34 have inner tapered surfaces to interlock with the conical assembly members 46. In the depicted example, the segmented housing members 34 portion of the integrated motor/pump rotor 18 are coupled back-to-back using the conical assembly members 46 and the bolts 50 and they collectively define a structural shell of the device 10. More specifically, the housing member 34 is coupled to the conical assembly member 46 using a plurality of illustrative bolts 50 that extend through openings 34C in the housing member 34 and thread into threaded openings 46A in the conical assembly part 46. The bolts 50 also engage shoulders 34D on the housing member 34. It should be noted that, for assembly purposes, the tapered or conical assembly member 46 is made of two or more axially split pieces (e.g., a split ring) that, when assembled in the operational location, form a tapered or conically shaped ring 46

Reference will be made to FIGS. 1C, 3, 4 and 5A-5B to identify various tapered or conical surfaces that engage one another to secure various components within the device 10 and generally describe how the components engage one another. With reference to FIG. 1C, the outer shell 40 may be secured around the outer surface 42X of the permanent magnet assembly 42 using an adhesive or other like material. In other cases, the outer shell 40 may take the form of a wrapped, heat shrink or compressed sleeve that secured around the outer surface 42X of the permanent magnet assembly 42. In the example where the device includes a separate shaped inner core 44 component, the outer surface 44X of the shaped inner core 44 may be machined so as to match the inner surface 42Y of the permanent magnet assembly 42 in such a manner so that the shaped inner core 44 may be inserted within the permanent magnet assembly 42 and secured in position using an adhesive material or by the non-magnetic retaining outer sleeve 40. A tapered surface 44A on the inner surface of the shaped inner core 44 abuts and engages a tapered or conical surface 46A on the outside of the conical assembly member 46. A tapered surface 44B on the inner surface of the shaped inner core 44 abuts and engages a tapered or conical surface 34D on the outside of the housing member 34.

With reference to FIGS. 3, 4 and 5A-5B, a channel 34E is machined in the segmented housing members 34 for seating a hydraulic seal which separates the process fluid flowing inside the segmented housing members 34 from the cooling fluid in the spaces 22 within the housing 12 on the outside of the integrated motor/pump rotor 18. The seal may be established using any of a variety of known techniques. In one embodiment, the seal may be established by metal-to-metal contact between portions of the upstream and downstream housing members 34. In other applications, the upstream and downstream housing members 34 may be operatively sealed to one another by positioning as gasket (not shown) or the like between the upstream and downstream housing members 34. Of course, as noted above, the rotatable housing members 34 are part of the of the electromagnetic rotor 18 and the housing members 34 rotate together as a unit around the fixed shaft 16 during operation.

Figure 6:
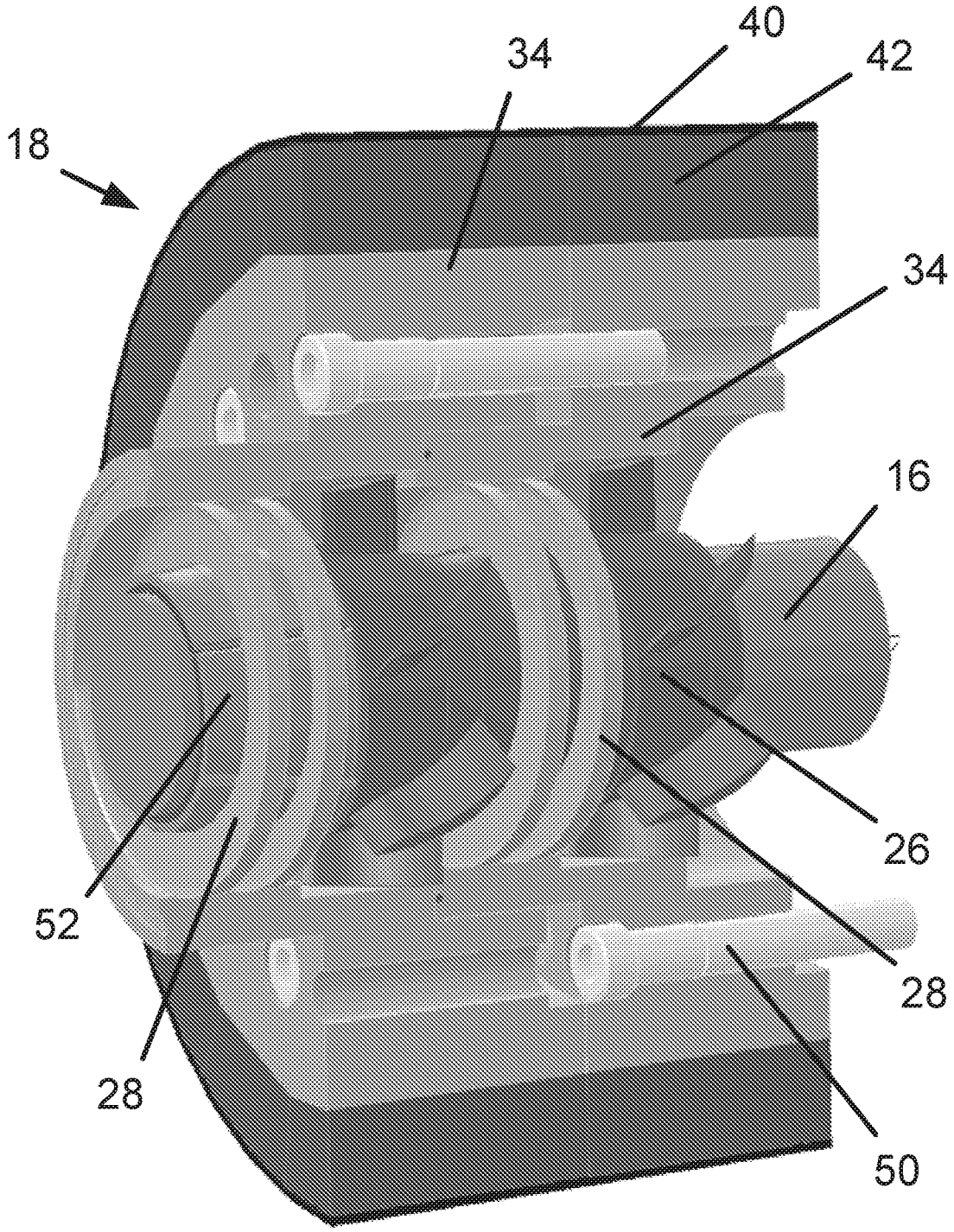
FIG. 6 is a perspective, cross-sectional view of one illustrative embodiment of a portion of a more compact version of an integrated modular, multi-stage motor—pump/compressor device that depicts a unique journal bearing disclosed herein.

FIG. 6 is a perspective, cross-sectional view of an illustrative embodiment of a device 10 comprising of two integrated motor pump/compressor rotor stages 30 with a design the is functionally similar to the design depicted in FIGS. 5A-5B but without tapered or conical members 46. In this embodiment, the fasteners 50 and the through holes threading into the housing members 34 are radially alternated to provide a back-to-back system assembly. This embodiment provides a somewhat more compact design. Such a compact design can lead to advantageous weight reductions and lower costs.

Figure 7:
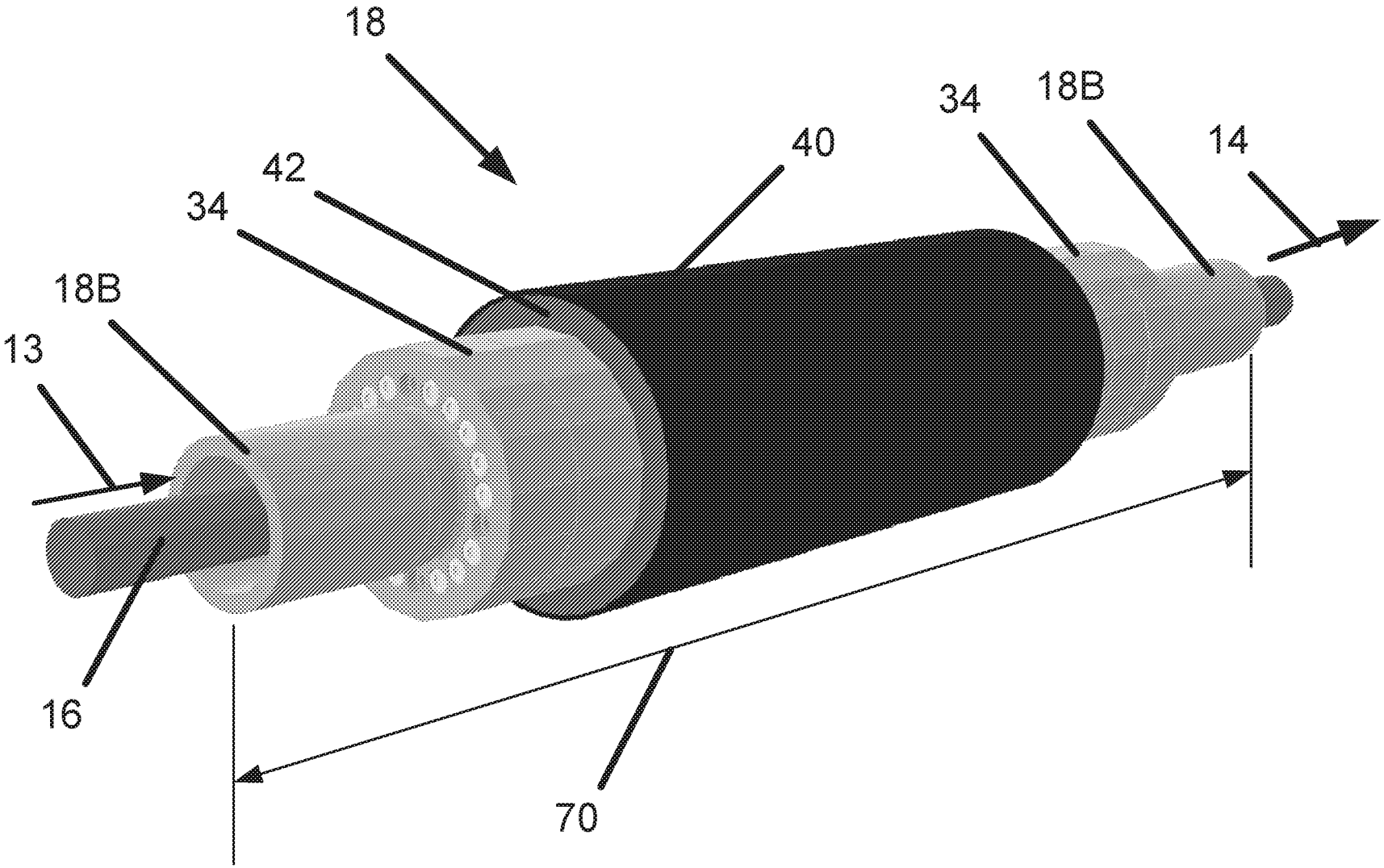
FIG. 7 is a perspective view of one illustrative embodiment of a rotatable integrated motor/pump rotor disclosed herein.

FIG. 7 is a perspective view of one illustrative embodiment of the integrated motor/pump rotor 18 disclosed herein that comprises the outer shell 40. the integrated motor—pump/compressor rotor stages 30, the permanent magnet assembly 42 and the pump/compressor hydraulic components 26, 28 and 52. Also depicted are the fluid inlet 13, the fluid outlet 14 and the non-rotating shaft 16. As depicted, the outer shell 40 is positioned around the outer surface of the permanent magnet assembly 42 of the integrated. motor/pump rotor 18.

In general, the components of the various devices 10 disclosed herein may be made of a variety of different materials and they may be manufactured in a variety of different sizes, all of which depend upon the particular application. The shaped inner core 44, the conical assembly member 46 and the segmented housing members 34 may be made of a ferromagnetic material. In one illustrative embodiment, the non-rotating shaft 16 may be a solid cylindrical bar of material that is comprised of, for example, a hard material (e.g., titanium) with a high chemical resistance to the composition of the process fluid. In other embodiments, the shaft 16 may be a hollow shaft made of similar materials. The outer shell 40 may be comprised of a non-magnetic material such as PTFE or a composite material such as carbon fiber, it may have an outer diameter that falls within the range of about 400 mm or more, and its radial thickness may vary depending upon the particular application. The overall length 70 (see FIG. 7) of the assembled integrated motor/pump rotor 18 may vary depending upon the particular application. The fixed conical member 32, the segmented rotatable journal bearing 52 and the impellers 28 may all be made of materials such as, for example, titanium or chemical resistant alloys like Inconel or super-duplex. In the illustrative example where the integrated motor/pump rotor 18 comprises a permanent magnet assembly 42, the electromagnet elements of the permanent magnet assembly 42 may be comprised of a material such rare earth magnets and the dimensions of the permanent magnet assembly 42, e.g. radial thickness, may vary depending upon the particular application.

After a complete reading of the present application, those skilled in the art will appreciate several unique and functional aspects (some of which are discussed below in no particular order of importance) of the various embodiments of the integrated motor pump/compressor device 10 disclosed herein. First, the device 10 is modular in nature and it is adaptable for use in a variety of applications. That is, the device 10 may be comprised of any number of pump/compressor stages 30. Accordingly, the device 10 can be specifically tailored and optimized for a particular application to maximize operational efficiencies and to reduce costs.

Figure 8:
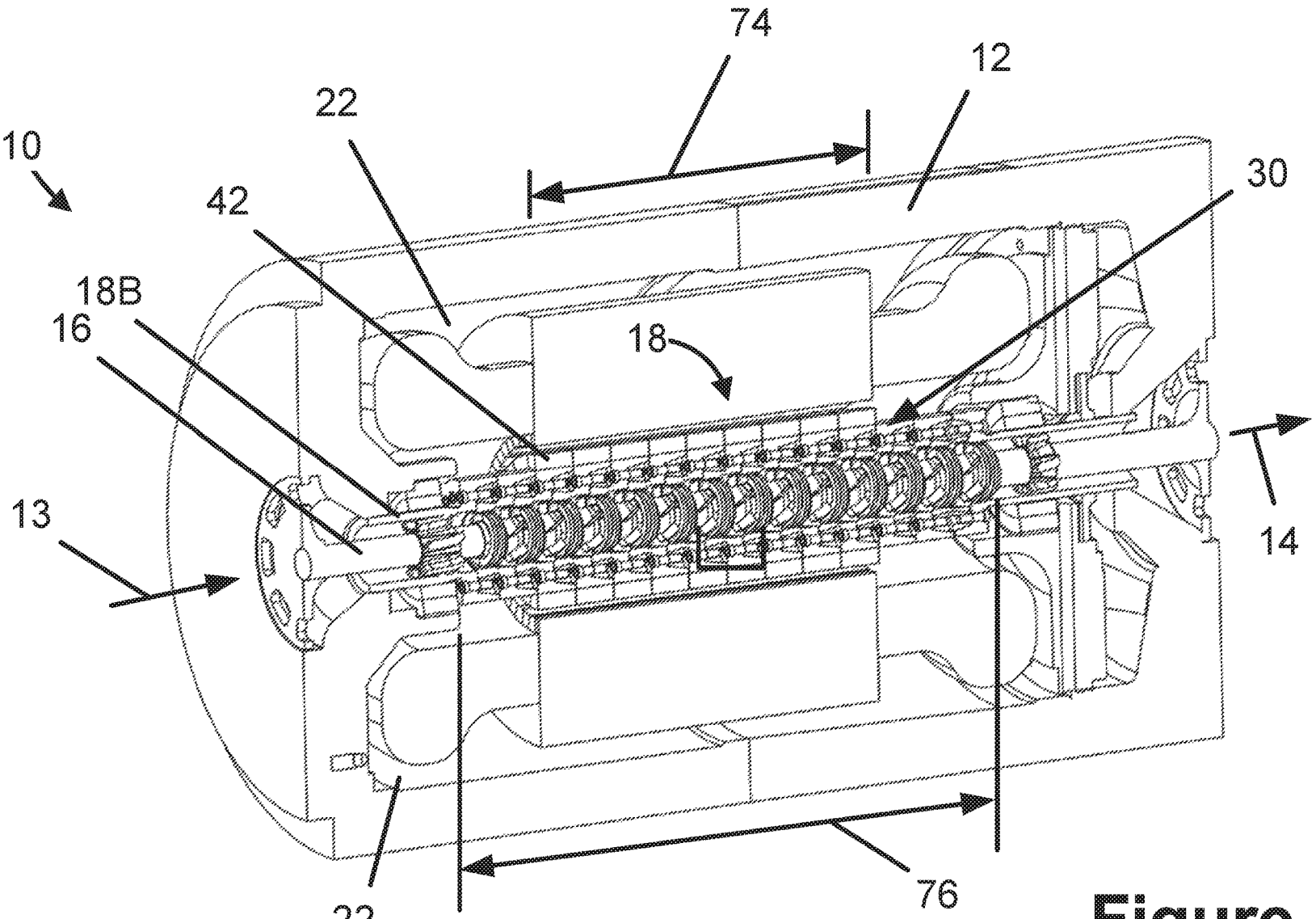
FIG. 8 is a perspective, cross-sectional view of one illustrative embodiment of an integrated modular, multi-stage motor pump/compressor device disclosed herein.

A second aspect of the device 10 provides for the independent optimization of the size of the motor portion (e.g., the permanent magnet assembly 42 portion) of the device 10 and the size of the pump/compressor portions (i.e., the stages 30) of the device, in general, the efficiency of a motor is greater than the efficiency of a pump/compressor. Thus, in some prior art applications, the motor would be oversized relative to the size of the pump/compressor, thereby resulting in reduce operational efficiencies and increased cost. Given the nature of the structure of the device 10 disclosed herein, it is possible to independently size the motor portion of the device 10 (i.e., the permanent magnet assembly 42 portion of the integrated motor/pump rotor 18) and the pump/compressor portion of the device (i.e., the number of pump/compressor stages 30) so as to increase operational efficiencies and reduce cost. For example, with reference to FIG. 8 (which corresponds to the embodiment shown in FIG. 1A), the "motor" portion of the device 10, i.e., the permanent magnet assembly 42 has an axial length 74 that is less than the axial length 76 of the plurality of pump/compressor stages 30. As noted above, this permits the permanent magnet assembly 42 to be sized so as to efficiently drive the load produced by the plurality of pump/compressor stages 30 without mandating that the permanent magnet assembly 42 be of the same physical size of the pump/compressor portion of the device 10.

A third point worth noting relates to aspects of the device 10 that reduce operational losses of the pump/compressor portions of the device 10. More specifically, as noted above, irrespective of the manner in which the impellers 28 are operatively coupled to or formed as part of the housing members 34, the helical-like or screw-like primary process fluid flow path 36 is very efficient and little to no process fluid can bypass the impellers 28. More specifically, as the impellers 28 are rotated (by actuation of the integrated motor/pump rotor 18), the process fluid flowing through the device 10 is urged or forced radially outward against the inside surface 34A of the housing members 34 and away from the bypass process fluid flow gap 37 (see FIG. 3) as the process fluid is compressed. Thus, there is very small percentage of process fluid that can bypass the compression provided by the impellers 28 since the process fluid that is forced radially outward (against the inner surface 34A) cannot escape or bypass the impeller 28. Accordingly, the efficiency of the pump/compressor stages 30 is increased which results in a greater overall operating efficiency for the device 10.

Fourth, in the various embodiments of the device 10 disclosed herein, various components of the device may be sized so as to reduce the overall weight and bulk of the device thereby reducing costs. For example, with reference to FIG. 1B, the empty spaces 22 within the housing 12 between the internal components of the device 10, e.g., the spaces 22 between the outer shell 40 and the inside surface of the housing 12 of the device 10 may be filled with a fluid (not shown), such as a cooling fluid, that is maintained at a pressure that is slightly above the operating pressure of the process fluid (gas, liquid, or gas-liquid combination) that flows through the pump/compressor stages 30 of the device 10. For example, in the case where the process fluid is at a pressure of 15 ksi, the cooling fluid within the spaces 22 may be maintained at a pressure that is about 10% above the anticipated operating pressure of the process fluid. This higher pressure cooling fluid in the spaces 22 insures that, if a leak is present, no process fluid will leak into the spaces 22. The volume and/or pressure of the fluid in the spaces 22 may be monitored during device operations. Operational loss of the cooling fluid can be mitigated by providing an external source of the cooling fluid. Since the housing 12 is designed, sized and functions as a pressure vessel that can contain the fluids (cooling and process) in any worst case condition, at least some of the components of the integrated motor/pump rotor 18 need not be designed and sized as a pressure vessel, which in turn will reduce their overall weight and thickness. That is, given the presence of the pressure vessel designed housing 12, various components of the device 10, like the segmented housing members 34 that are arranged in a tubular configuration 18 may be sized and designed based upon the lower differential pressure between the process fluid flowing through the inside of the integrated motor/pump rotor 18 and the cooling fluid (at a slightly higher pressure) positioned on the outside integrated motor/pump rotor 18 in the spaces 22 inside the housing 12.

Figure 9:
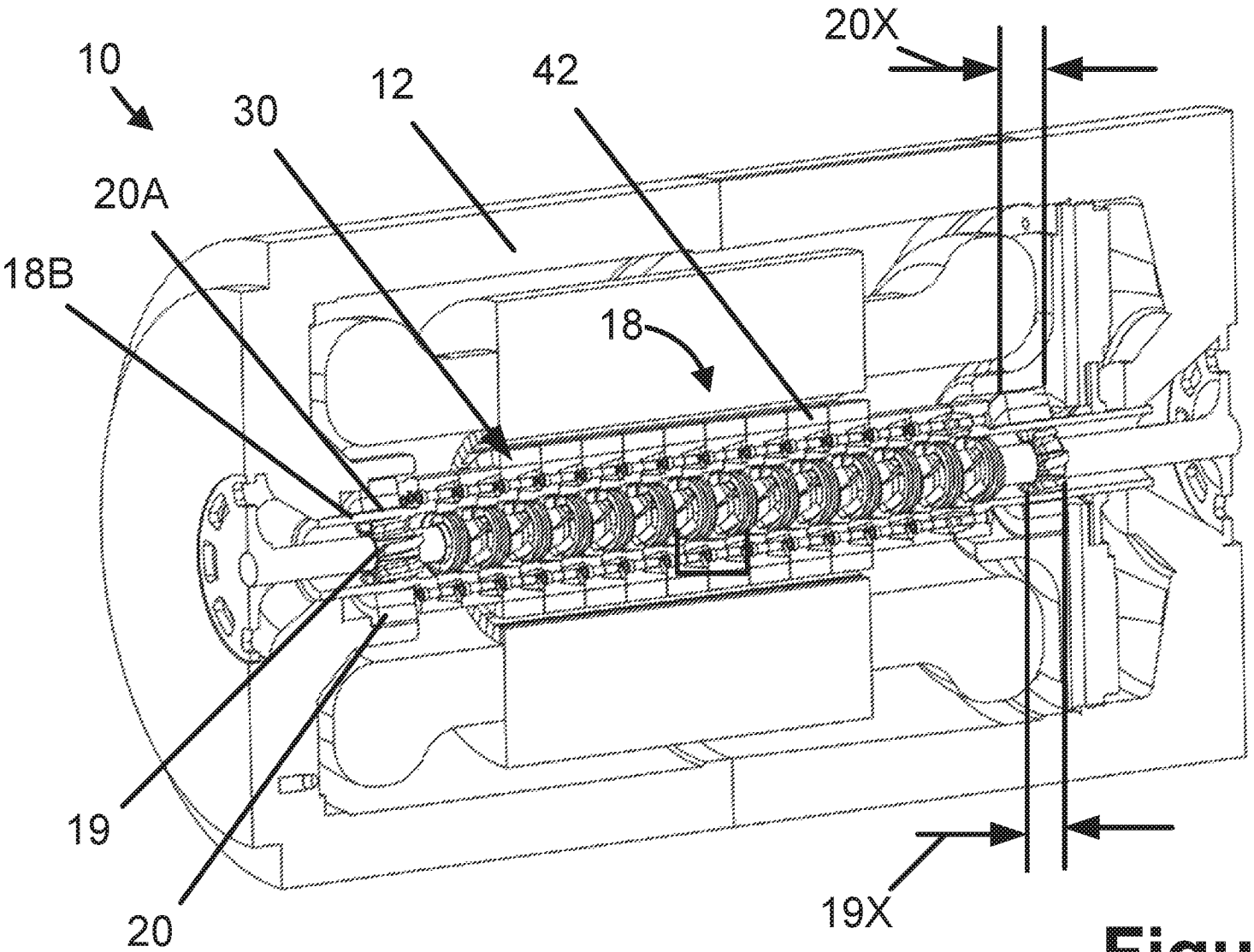
FIG. 9 is a perspective, cross-sectional view of one illustrative embodiment of an integrated modular, multi-stage motor—pump/compressor device that depicts a unique bearing design disclosed herein.

Fifth, with reference to FIG. 9, the use of the combination of the illustrative internal journal bearings 19 and outer journal bearings 20 to support the rotational movement of the integrated motor/pump rotor 18 as it rotates relative to the motor stator assembly 25 is believed to be novel arrangement that insures stability of the integrated motor/pump rotor 18 as it rotates during operation. More specifically, in one illustrative embodiment, the bearings 19, 20 are positioned such that at least a portion of the inner journal bearings 19 is positioned within at least a. portion of the overall opening 20A in the outer journal bearings 20. Stated another way, the bearings 19, 20 are positioned such that the axial length 19X of the inner journal bearing 19 overlap, to at least some degree, the axial length 20X of the outer journal hearings 20 along the axial length of the integrated motor/pump rotor 18. In some applications, the center of the axial length 19X of the inner journal bearing 19 may be approximately aligned with the center of the axial length 20X of the outer journal bearing 20. This unique configuration of having the integrated motor/pump rotor 18 (more specifically, the extended length portions 18B) positioned between the outer journal bearings 20 and the inner journal bearings 19 and in the presence of the axially distributed journal bearings 52 provides rotor dynamic stability to the integrated motor/pump rotor 18 from the outside (bearings 20) and the inside (bearings 19) during operation.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

The invention claimed is:

1. A device, comprising:

an outer housing;

a non-rotating cylindrical shaft fixedly positioned within the housing;

an electric motor stator positioned within the outer housing;

a rotatable integrated motor/pump rotor positioned within the electric motor stator, the rotatable integrated motor/pump rotor comprising at least one electromagnet driver device that is adapted to be electromagnetically coupled with the electric motor stator and multiple pump stages each comprising at least one impeller, where an inner surface of the rotatable integrated motor/pump rotor and the impeller define a primary process fluid flow path within the rotatable integrated motor/pump rotor;

wherein the integrated motor/pump rotor comprises a plurality of rotatable segmented housing members secured to one another in back-to-back fashion, wherein each of the plurality of segmented housing members comprises at least one impeller that is rotationally fixed to an inner surface of the segmented housing member, the integrated motor/pump rotor further comprising a diffuser that is rotationally fixed to the non-rotating shaft and located entirely within the segmented housing members; and further comprising a conical member positioned between the at least one impeller and the non-rotating shaft, the conical member rotationally fixed to the non-rotating shaft, and wherein the at least one impeller is formed integrally with the segmented housing member.

2. The device of claim 1, wherein at least one electromagnet driver device comprises a plurality of permanent magnets, an induction motor segment or a combination of a plurality off permanent magnets and an induction motor squirrel cage segment.

3. The device of claim 1, wherein the rotatable integrated motor/pump rotor is positioned around the non-rotating shaft and the rotatable integrated motor/pump rotor is adapted to rotate around the non-rotating shaft during operation.

4. A device, comprising:

an outer housing;

an electric motor stator positioned within the outer housing; and a rotatable integrated motor/pump rotor positioned within the electric motor stator, the rotatable integrated motor/pump rotor comprising at least one electromagnet driver device that is adapted to be electromagnetically coupled with the electric motor stator and multiple pump stages each comprising at least one impeller, where an inner surface of the rotatable integrated motor/pump rotor and the impeller define a primary process fluid flow path within the rotatable integrated motor/pump rotor;

further comprising a non-rotating shaft fixedly positioned within the housing, wherein the rotatable integrated motor/pump rotor is positioned around the non-rotating shaft and the rotatable integrated motor/pump rotor is adapted to rotate around the non-rotating shaft during operation;

further comprising a diffuser rotationally fixed to the non-rotating shaft wherein the diffuser is positioned axially downstream of the impeller so as to accept process fluid that flows through the at least one impeller; and further comprising a conical member positioned between the at least one impeller and the non-rotating shaft, the conical member rotationally fixed to the non-rotating shaft, and wherein the at least one impeller is formed integrally with the segmented housing member.

5. The device of claim 3, further comprising a segmented rotatable journal bearing positioned between the at least one impeller and the non-rotating shaft.

6. The device of claim 5, wherein the segmented rotatable journal bearing is coupled to the at least one impeller and the segmented rotatable journal bearing adapted to rotate around the non-rotating shaft with the at least one impeller.

7. The device of claim 3, wherein the rotatable integrated motor/pump rotor is rotationally supported by an plurality of external journal bearings positioned between a portion of the outer housing and around an outer surface of the rotatable integrated motor/pump rotor and a plurality of inner journal bearings that are positioned between an inner surface of the rotatable integrated motor/pump rotor and an outer surface of the non-rotating shaft, wherein the inner journal bearings are fixedly attached to the inner surface of the rotatable integrated motor/pump rotor.

8. The device of claim 7, wherein the inner journal bearings have an axial length (19X) and the outer journal bearings have an axial length and wherein the inner journal bearings are positioned along the rotatable integrated motor/pump rotor such that the axial length (19X) of the inner journal bearings overlap at least partially with the axial length of the outer journal bearings along an axial length of the rotatable integrated motor/pump rotor.

9. The device of claim 1, further comprising a plurality of additional at least one impellers wherein the at least one electromagnet driver device has a first axial length along the rotatable integrated motor/pump rotor and the plurality of the additional at least one impellers have a second axial length along the rotatable integrated motor/pump rotor that is greater than the first axial length.

10. The device of claim 1, wherein a minimum thickness of each of the plurality of segmented housing members is mechanically designed based upon a differential pressure between a first pressure of a process fluid flowing through the rotatable integrated motor/pump rotor and a second pressure of a fluid positioned within the outer housing and external to an outer surface of the rotatable integrated motor/pump rotor, wherein the second pressure is greater than the first pressure.

11. The device of claim 5, wherein an axial position of the segmented rotatable journal bearing along the non-rotating shaft is secured by the diffuser that is rotationally and axially fixed to the non-rotating shaft by a locking key.

12. The device of claim 5, wherein an axial position of the impeller along the non-rotating shaft is secured by the segmented rotatable journal bearing.

13. The device of claim 4, further comprising a conical member positioned between the at least one impeller and the non-rotating shaft.

14. The device of claim 13, wherein the rotatable integrated motor/pump rotor comprises a segmented housing member and wherein the at least one impeller is formed integrally with the segmented housing member.

15. The device of claim 14, wherein the rotatable integrated motor/pump rotor is rotationally supported by an plurality of external journal bearings positioned between a portion of the outer housing and around an outer surface of the rotatable integrated motor/pump rotor and a plurality of inner journal bearings that are positioned between an inner surface of the rotatable integrated motor/pump rotor and an outer surface of the non-rotating shaft, wherein the inner journal bearings are fixedly attached to the inner surface of the rotatable integrated motor/pump rotor.

* * * * *